US009382680B2

(12) United States Patent
Yamada et al.

(10) Patent No.: US 9,382,680 B2
(45) Date of Patent: Jul. 5, 2016

(54) AUGER SNOW-REMOVING MACHINE

(71) Applicant: Honda Motor Co., Ltd., Tokyo (JP)

(72) Inventors: Atsushi Yamada, Wako (JP); Fumiyoshi Kanbara, Wako (JP); Masahiro Akiyama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 44 days.

(21) Appl. No.: 14/448,261

(22) Filed: Jul. 31, 2014

(65) Prior Publication Data

US 2015/0033591 A1 Feb. 5, 2015

(30) Foreign Application Priority Data

Aug. 2, 2013 (JP) ..... 2013-161591

(51) Int. Cl.
*E01H 5/09* (2006.01)

(52) U.S. Cl.
CPC ..... *E01H 5/098* (2013.01)

(58) Field of Classification Search
CPC ..... E01H 5/04; E01H 5/045; E01H 5/08
See application file for complete search history.

(56) References Cited

U.S. PATENT DOCUMENTS 6,453,583 B1 * 9/2002 Hanafusa ..... E01H 5/04 37/243
6,539,649 B2 * 4/2003 Sueshige ..... E01H 5/04 192/17 R
6,931,771 B1 * 8/2005 Liebl ..... E01H 5/045 37/248
2005/0241190 A1 * 11/2005 Kettering ..... E01H 5/098 37/258

FOREIGN PATENT DOCUMENTS

JP 08-013439 1/1996
JP 2004-360379 12/2004

OTHER PUBLICATIONS

European Search Report dated Dec. 19, 2014, 7 pages.

* cited by examiner

*Primary Examiner* — Jamie L McGowan
(74) *Attorney, Agent, or Firm* — Rankin, Hill & Clark LLP

(57) ABSTRACT

An auger snow-removing machine includes a forward rotation shaft and a reverse rotation shaft disposed on the same axis and aligned in a width direction of an auger housing within the auger housing, and a transmission disposed inside the auger housing such that the forward rotation shaft and the reverse rotation shaft are rotated concurrently in opposite directions by a driving force transmitted from the transmission. A case of the transmission is divided into a front case member and a rear case member at a position behind a reverse rotation drive shaft extending in the width direction of the auger housing. The front case member has a first gear unit assembled therein, and the rear case member has a second gear unit assembled therein. The first and second gear units are assembled together when the front and rear case members are assembled together.

2 Claims, 9 Drawing Sheets

AUGER SNOW-REMOVING MACHINE

FIELD OF THE INVENTION

The present invention relates to an auger snow-removing machine and more particularly to an improvement in an auger transmission of the auger snow-removing machine.

BACKGROUND OF THE INVENTION

Auger snow-removing machines having an auger housed in an auger housing at the front end of a machine body are known. The auger snow-removing machine, as it travels forward, is able to collect snow using the auger and throw the collected snow via a shooter to a distant place using a blower. A typical example of such auger snow-removing machines is disclosed in Japanese Patent Application Laid-open Publication (JP-A) No. 2004-360379.

The disclosed auger snow-removing machine includes a forward rotation shaft provided with a forward rotation auger and a reverse rotation shaft provided with a reverse rotation auger that are disposed on the same axis and aligned in a width direction of an auger housing within the auger housing. The forward rotation shaft and the reverse rotation shaft are rotated concurrently in opposite directions by a driving force transmitted from a transmission disposed inside the auger housing.

The transmission is comprised of an input shaft to which a driving force from an engine is inputted, a reverse rotation drive shaft connected to the reverse rotation shaft, a forward rotation drive shaft connected to the forward rotation shaft, a driving gear provided on the input shaft, a first driven gear provided on the reverse rotation drive shaft and meshing with the driving gear, a counter gear meshing with the first driven gear, an idle gear mechanism for converting rotation of the counter gear to a reverse rotation, a second driven gear provided on the forward rotation drive shaft and meshing with an output gear of the idle gear mechanism, and a case that houses the foregoing members.

The input shaft is arranged to extend in a front-rear direction of the auger housing. The reverse rotation drive shaft and the forward rotation drive shaft extend in the width direction of the auger housing. The counter gear and the idle gear mechanism are positioned rearward of the reverse rotation drive shaft.

The case is composed of a left case member and a right case member that are separated in a longitudinal or axial direction of the reverse rotation drive shaft. With this arrangement, these parts of the case which are provided for retaining bearings or seals are to be formed on both the left case member and the right case member in an axially aligned condition. To secure a desired level of machining accuracy, it is preferable that the bearing/seal retaining parts are subjected to a machining process while the left and right case members are kept in an assembled state. However, such machining process is not fully satisfactory in terms of the workability of the case, machining accuracy of the bearing/seal retaining parts, and the sealing property of the seal retaining parts.

It may be considered that the case is divided into a front case member and a rear case member at a position before the reverse rotation drive shaft. In this case, the counter gear and the idle gear mechanism are assembled in the rear case member. This arrangement, however, brings about low assembly workability.

An attempt may be made to arrange the counter gear and the idle gear mechanism ahead of the reverse rotation drive shaft. However, the attempted arrangement will result in a case having a front end largely projecting forward from the reverse rotation drive shaft within the auger housing, allowing snow to adhere to and stay on a front part of the case as the snow is collected by the auger toward a widthwise center of the auger housing.

It is therefore an object of the present invention to provide an auger snow-removing machine which is capable of preventing snow from adhering to and staying on a transmission case during snow-removing operation by an auger while keeping desired levels of sealing property, workability and machining accuracy of the transmission case.

SUMMARY OF THE INVENTION

According to the present invention, there is provided an auger snow-removing machine comprising: an auger housing; a forward rotation shaft provided with a forward rotation auger and a reverse rotation shaft provided with a reverse rotation auger, the forward rotation shaft and the reverse rotation shaft being disposed on the same axis and aligned in a width direction of the auger housing within the auger housing; and a transmission disposed inside the auger housing such that the forward rotation shaft and the reverse rotation shaft are rotated in opposite directions by a driving force transmitted from the transmission, wherein the transmission includes: an input shaft to which the driving force is inputted; a reverse rotation drive shaft connected to the reverse rotation shaft and extending in the width direction of the auger housing; a forward rotation drive shaft connected to the forward rotation shaft; a driving gear provided on the input shaft; a first driven gear provided on the reverse rotation drive shaft and meshing with the driving gear; a counter gear meshing with the first driven gear; an idle gear mechanism for converting rotation of the counter gear to rotation in a reverse direction, the idle gear mechanism having an output gear; a second driven gear provided on the forward rotation drive shaft and meshing with the output shaft of the idle gear mechanism; and a case, wherein the case is a split case divided into a front case member and a rear case member at a position behind the reverse rotation drive shaft, wherein the front case member has a first gear unit assembled therein, the first gear unit including the input shaft, the reverse rotation drive shaft, the forward rotation drive shaft, the driving gear, the first driven gear, and the second driven gear, and wherein the second case member has a second gear unit assembled therein, the second gear unit including the counter gear, and the idle gear mechanism.

With this arrangement, because the case of the transmission disposed inside the auger housing is divided into the front case member and the rear case member at the position behind the reverse rotation drive gear, and because the front case member has the first gear unit assembled therein and the rear case member has the second gear unit assembled therein, a protrusion length of the case within the auger housing, which is an amount of protrusion of a front end of the case in a forward direction from the reverse rotation drive shaft, can be reduced. With the case thus having a reduced forward protrusion length, snow collected by the auger within the auger housing is hard to adhere to and stay on a front part of the case. As a result, a highly efficient snow-removing operation can be achieved.

Additionally, because the first gear unit and the second gear unit are assembled in the front case member and the rear case member, respectively, before the front and rear case members are assembled together, the first and second gear units can readily be brought into an assembled state when the front and rear case member are assembled together. The first gear unit, as it is in an assembled state with respect to the front case member, has a structure to ensure that phases of gears of the first gear unit can be aligned with utmost ease. Similarly, the second gear unit, as it is in an assembled state with respect to the rear case member, has a structure to ensure that phases of gears of the second gear unit can be aligned with utmost ease.

Unlike an arrangement in which the transmission case is divided into two case members in an axial direction of the reverse rotation drive shaft, the case, which is divided into the front and rear case members in a direction perpendicular to an axis of the reverse rotation drive shaft, allows the front and rear case members to be machined separately and independently when bearing/seal retaining portions for receiving respectively therein bearings/seals are produced in the front and rear case members. Such separate and independent machining process insures enhanced workability and machining accuracy of the case and high sealing property of the seal retaining portions.

Furthermore, the overall size of the case is not greater than, but substantially the same as, that of the case shown in JP 2004-360379 A. Additional to the enhanced sealing property, workability and machining accuracy of the case, the transmission is able to achieve high assembly workability while maintaining compactness thereof.

Preferably. the driving gear is a worm or a screw gear, the first driven gear and the counter bear are helical gears, and the front case member is mounted to the auger housing and provided with a bearing capable of retaining a thrust reaction force occurring at the input shaft when the forward rotation auger is undergoing forward rotation and the reverse rotation auger is undergoing reverse rotation concurrently with forward rotation of the forward rotation auger.

With this arrangement, because the direction of acting on the case by the thrust reaction force is an axial forward direction of the input shaft, the front case member can sufficiently retain the thrust reaction force as compared to an arrangement in which the rear case member is used to retain the thrust reaction force.

Furthermore, by using the driving gear formed by a worm or a screw gear, the input shaft is allowed to extend in a front-rear direction of the auger housing. Since the case is split into the front and rear case members, it is possible to arrange a front bearing at the front case member for supporting a front part of the input shaft and also to arrange a rear bearing at the rear case member for supporting a rear part of the input shaft. With this arrangement, when a machining process is to be performed on the front and rear case members so as to provide bearing retaining portions where the front and rear bearings are received, the front case member and the rear case member can be machined separately and independently, which will lead to enhanced machining accuracy. More specifically, the distance between the front bearing and the rear bearing can be finished with increased accuracy. Furthermore, because the front part of the input shaft, the forward rotation drive shaft, and the reverse rotation drive shaft are provided in the front case member, it is readily possible to maintain an excellent meshing state between the driving gear and the first driven gear, which will lead to a reduction in the abrasion of gear teeth and an increased in the durability.

DETAILED DESCRIPTION OF THE PREFERRED EMBODIMENT

A certain preferred structural embodiment of the present invention will be described in detail below, by way of example only, with reference to the accompanying sheets of drawings, in which the reference signs Fr, Rr, Le, and Ri, respectively, denote a front side, a rear side, a left side, and a right side as viewed from an operator of an auger snow-removing machine 10 embodying the present invention.

Figure 1:
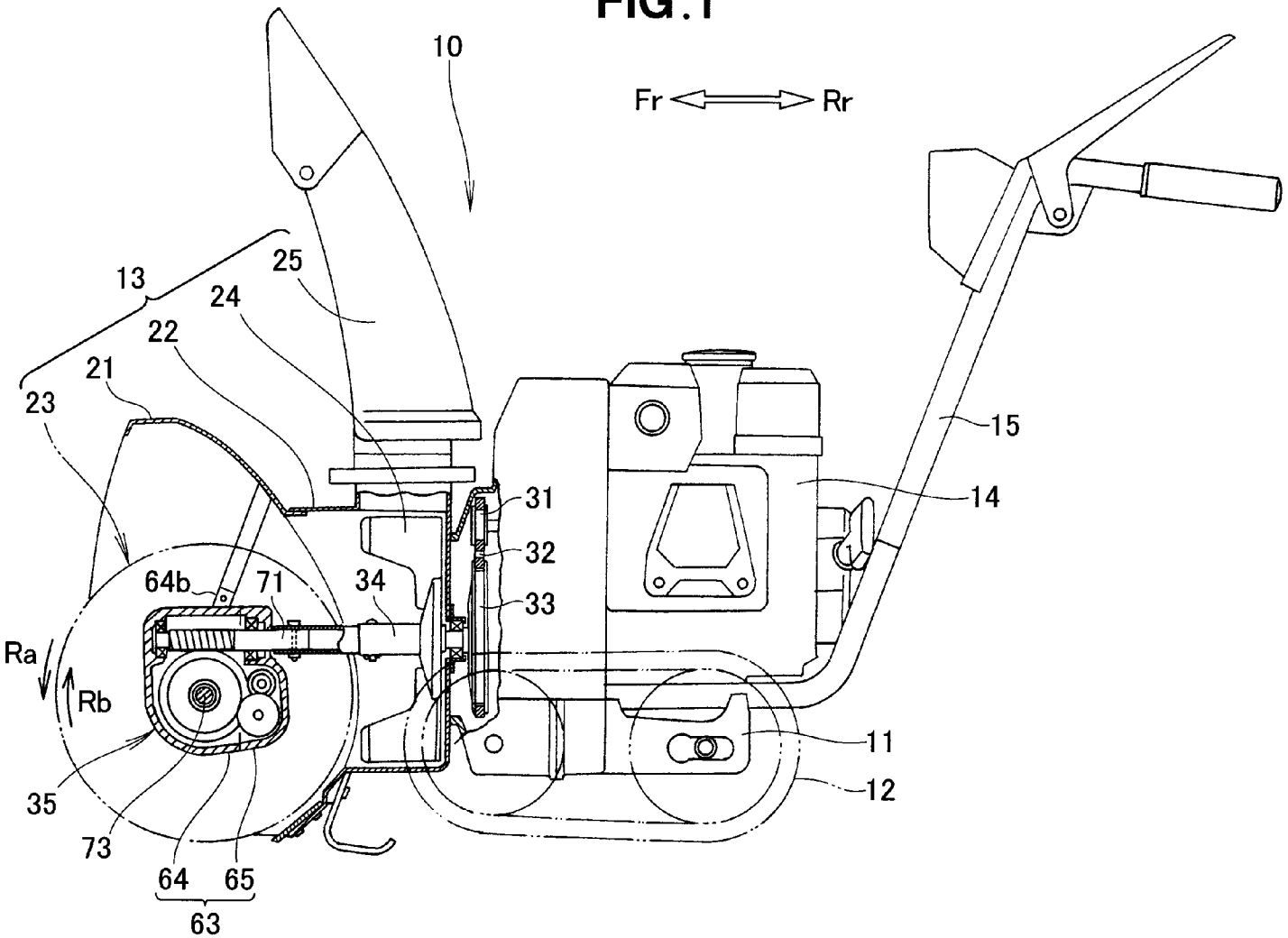
FIG. 1 is a side view of an auger snow-removing machine according to an embodiment of the present invention.

As shown in FIG. 1, the auger snow-removing machine 10 is a self-propelled walk-behind snow-removing machine having a traveling unit 12, a snow-removing work unit 13, and a power source 14 that are mounted on a machine body (body frame) 11 with an operation handle 15 extending rearwardly upward from a rear part of the body frame 11. The operator can operate or maneuver the self-propelled walk-behind auger snow-removing machine 10 (hereinafter referred to, for brevity, as "snow-removing machine") by operating the operation handle 15 while walking behind the snow-removing machine 10.

The snow-removing work unit 13 includes an auger housing 21, a blower housing 22 provided behind the auger housing 21 at a widthwise central portion of the auger housing 21, an auger 23 disposed within the auger housing 21, a blower 24 disposed inside the blower housing 22, and a shooter 25 extending vertically upward from the blower housing 22.

The power source 14 is provided for driving the traveling unit 12 and the snow-removing work unit 13 and constituted, for example, by an engine. Motive power from the power source 14 is transmitted to the blower 24 through a power transmission path formed jointly by a driving pulley 31, a power transmission belt 32, a driven pulley 33, and a transmission shaft 34. From the transmission shaft 34, the motive power from the power source 14 is also transmitted via a transmission 35 to the auger 23. With this arrangement, snow collected by the auger 23 is thrown by the blower 24 toward a distant place oriented by the shooter 25. The travelling unit 12 may be a motor-driven travelling unit.

The snow-removing work unit 13 will be described in greater detail. The blower housing 22 is mounted to the body frame 11. The blower 24 is mounted on the transmission shaft 34 within the blower housing 22. The transmission shaft 34 has a front end connected to an input shaft 71 of the transmission 35. The transmission 35 is disposed inside the auger housing 21.

Figure 2:
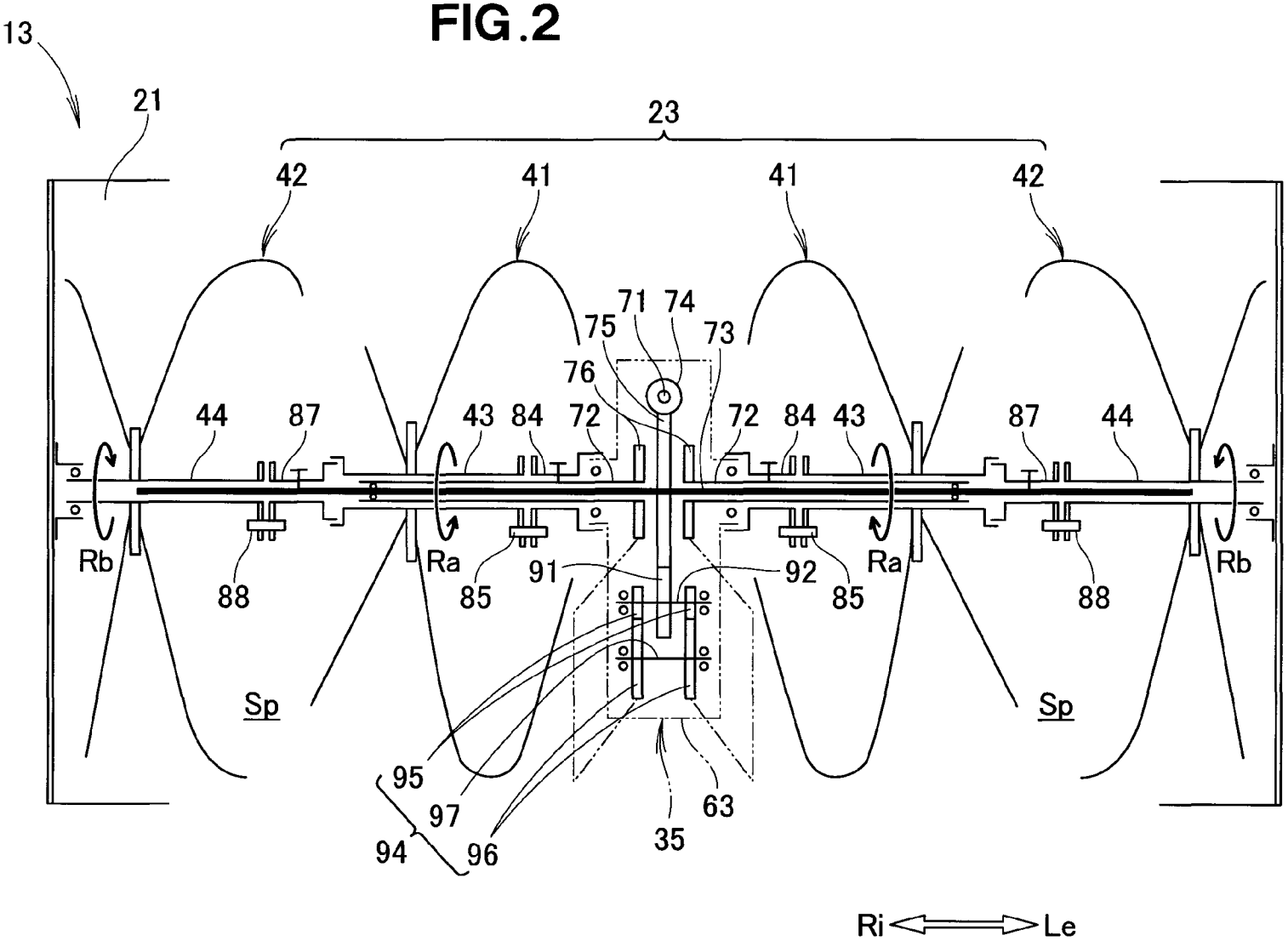
FIG. 2 is a front elevational view of the auger snow-removing machine, diagrammatically showing an auger driving system.

As shown in FIG. 2, the auger 23 is comprised of left and right forward rotation augers 41 and 41 adapted to rotate in a direction from upward to front-downward (as indicated by the arrow Ra) while the snow-removing machine 10 is in snow-removing operation, and left and right reverse rotation augers 42 and 42 adapted to be rotate in a direction (indicated by the arrow Rb) opposite to the direction of rotation of the forward rotation augers 41, 41 during snow-removing operation of the snow-removing machine 10. The left forward rotation auger 41 and the left reverse rotation auger 42 are juxtaposed with each other in an axial direction of the auger 23. Similarly, the right forward rotation auger 41 and the right reverse rotation auger 42 are juxtaposed with each other in the axial direction of the auger 23.

With respect to the rotating direction of the auger 23 which will occur during snow-removing operation of the snow-removing machine 10, rotation in the direction from upward to front-downward, i.e., the direction of arrow Ra (counter-clockwise direction in FIG. 1) is hereinafter referred to as "forward rotation", and rotation in the direction opposite to the rotating direction of the forward rotation augers 41, 41, i.e., the direction of arrow Rb (clockwise direction in FIG. 1) is hereinafter referred to as "reverse rotation".

The left and right forward rotation augers 41, 41 are strip-like members having a predetermined width and formed into a spiral shape. The left and right forward rotation augers 41, 41 are provided on left and right forward rotation shafts 43, 43, respectively. The left and right forward rotation augers 41, 41 have a spiral direction determined such that the left and right forward rotation augers 41, 41 while undergoing forward rotation can break snow and collect or gather the broken snow toward the widthwise central portion of the auger housing 21.

Similarly, the left and right reverse rotation augers 42, 42 are strip-like members having a predetermined width and formed into a spiral shape. The left and right reverse rotation augers 42, 42 are provided on left and right reverse rotation shafts 44, 44, respectively. The left and right reverse rotation augers 42, 42 have a spiral direction determined such that the left and right reverse rotation augers 42, 42 while undergoing reverse rotation can break snow and collect or gather the broken snow toward the widthwise central portion of the auger housing 21.

The left and right forward rotation shafts 43, 43 and the left and right reverse rotation shafts 44, 44 are disposed on the same axis and aligned with each other in the width direction of the auger housing 21 within the auger housing 21. More specifically, the left and right forward rotation shafts 43, 43 and the left and right reverse rotation shafts 44, 44 are coaxially disposed and located at a front part of the body frame 11 (FIG. 1). The left forward rotation shaft 44 and the left reverse rotation shaft 44 are axially juxtaposed with each other, and the right forward rotation shaft 43 and the right reverse rotation shaft 44 are axially juxtaposed with each other.

The transmission 35 is a transmission mechanism which transmits a driving force inputted from the power source 14 to the input shaft 71 to both the forward rotation shafts 43, 43 and the reverse rotation shafts 44, 44.

Figure 3:
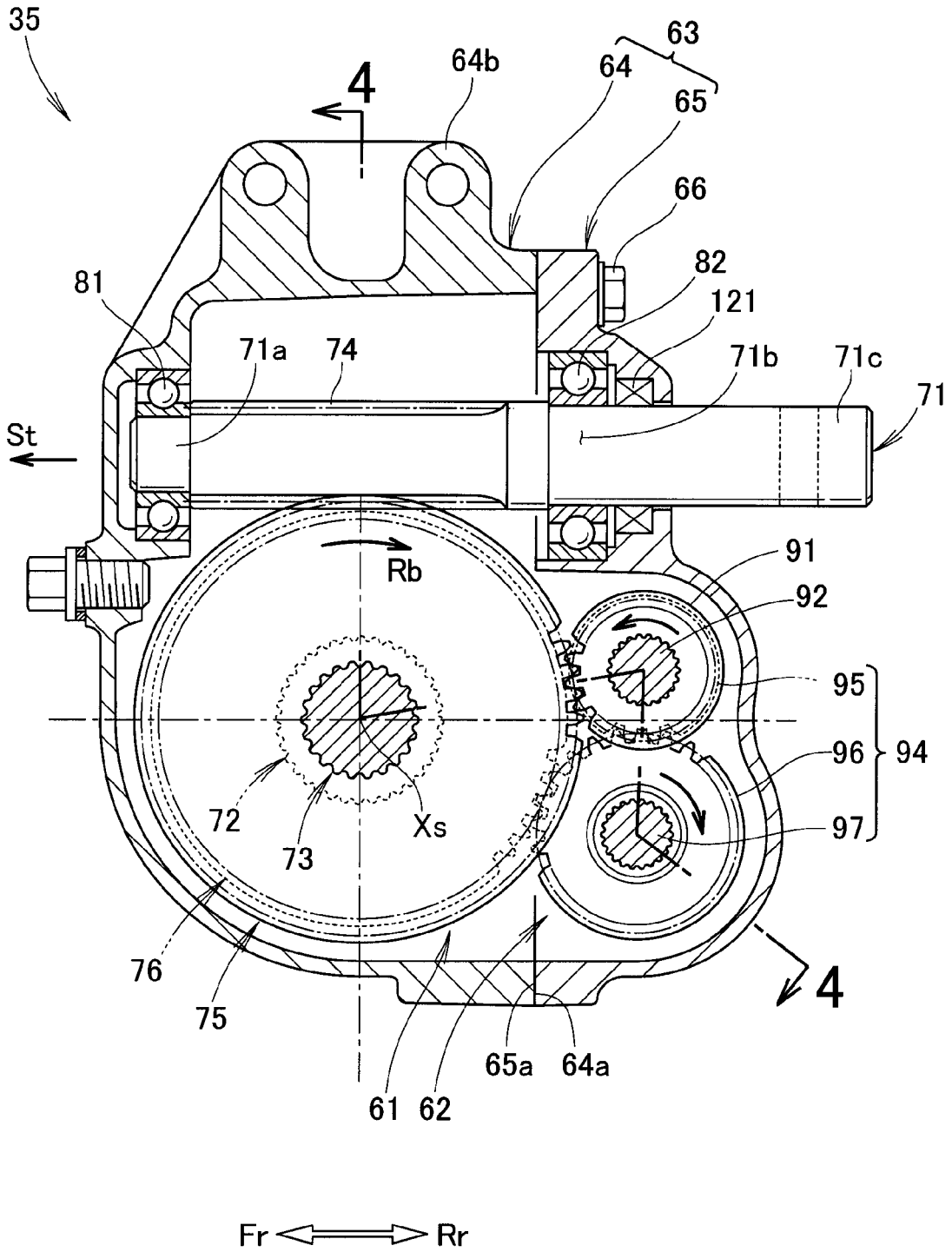
FIG. 3 is an enlarged cross-sectional view of a transmission of the auger snow-removing machine shown in FIG. 1.
Figure 4:
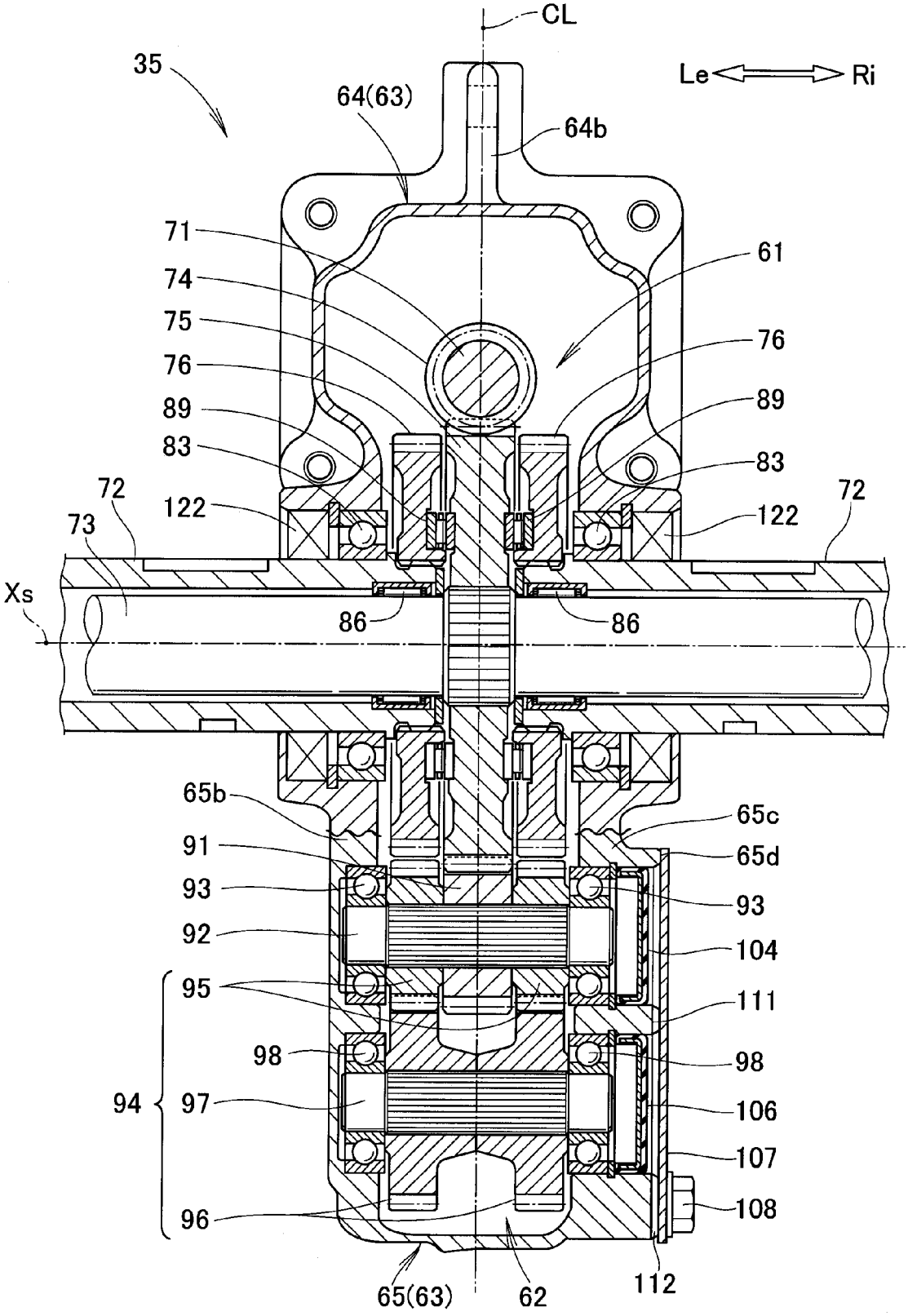
FIG. 4 is a cross-sectional view taken along line 4-4 of FIG. 3.

As shown in FIGS. 3 and 4, the transmission 35 is comprised of a first gear unit 61, a second gear unit 62 and a case 63 which houses the first and second gear units 61, 62. The first gear unit 61 includes the input shaft 71, left and right forward rotation drive shafts 72, 72, a single reverse rotation drive shaft 73, a single driving gear 74, a single first driven gear 75, and left and right second driven gears 76, 76. The second gear unit 62 includes a single counter gear 91 and a single idle mechanism 94.

Figure 5:
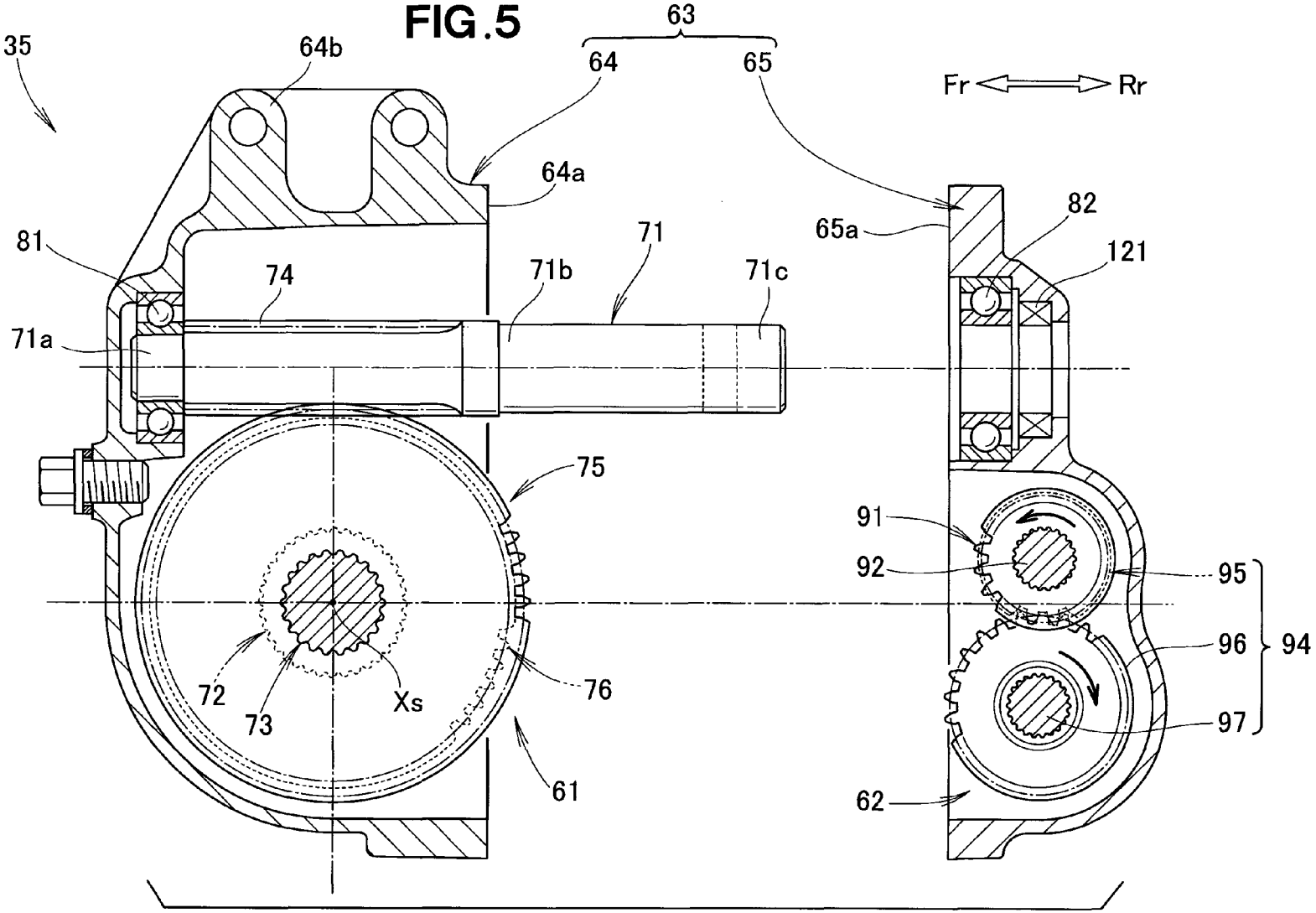
FIG. 5 is an exploded view of the transmission shown in FIG. 4 as it is split or divided in a front-rear direction of the auger snow-removing machine.

As shown in FIG. 2, the reverse rotation drive shaft 73 extends in the width direction of the auger housing 21. As shown in FIGS. 3 and 5, the case 63 is a split case which is divided into a front case member 64 and a rear case member 65 at a position located behind the reverse rotation drive shaft 73. The front case member 64 and the rear case member 65 are joined together by a plurality of bolts 66 (one shown in FIG. 3) with a rear end face 64*a* of the front case member 64 and a front end face 65*a* of the rear case member 65 being mated with each other.

The front case member 64 has an upper part 64*b* bolted to the auger housing 21 (FIG. 1). The front case member 64 has the first gear unit 61 assembled therein. The rear case member 65 has the second gear unit 62 assembled therein. The second gear unit 62 is located behind the first driven gear 75.

The input shaft 71 is disposed on a vertical plane including a center line CL (FIG. 4) in the width direction of the auger housing 21 and extends in a front-rear direction of the auger housing 21. The input shaft 71 has a front end portion 71*a* rotatably supported by a front part of the front case member 64 via a front bearing 81, and a longitudinal intermediate portion 71*b* rotatably supported by a rear part of the rear case member 65 via a rear bearing 82. The input shaft 71 further has a rear end portion 71*c* projecting rearward from the rear case member 65 so that the driving force from the power source 14 is inputted via the transmission shaft 34 (FIG. 1) to the input shaft 71.

As shown in FIGS. 2 to 4, the left and right forward rotation drive shafts 72, 72 extend in the width direction of the auger housing 21, project laterally outward from the case 63, and are connected to the left and right forward rotation shafts 43, 43, respectively. More specifically, the left and right forward rotation drive shafts 72, 72 are disposed on the same axis (i.e., the axis Xs shown in FIG. 4) and extend in the width direction of the auger housing 21. The left and right forward rotation drive shafts 72, 72 are constituted by pipe-shaped shafts rotatably supported by the case 63 of the transmission 35 via left and right bearings 83, 83. When the driving force is inputted to the input shaft 71, the left and right forward rotation drive shafts 72, 72 are rotatable only in the forward rotating direction Ra. The rotating direction Ra of the left and right forward rotation drive shafts 72, 72 is a direction to cause the left and right forward rotation augers 41, 41 to undergo forward rotation.

As shown in FIG. 2, the left and right forward rotation drive shafts 72, 72 are fitted with left and right forward rotation rotating shafts 84, 84 located near the case 63, and the left and right forward rotation shafts 43, 43 located remotely from the case 63. The left and right forward rotation shafts 43, 43 are constituted by pipe-shaped shafts relatively rotatably fitted over the left and right forward rotation drive shaft 72, 72, respectively. The left and right forward rotation rotating shafts 84, 84 are constituted by pipe-shaped shafts fitted over and connected with the left and right forward rotation drive shafts 72, 72, respectively. The left and right forward rotation rotating shafts 84, 84 are connected to the left and right forward rotation shafts 43, 43 by means of left and right forward rotation shear bolts 85, 85. The left and right forward rotation shear bolts 85, 85 are fastening members which can be shorn or broken by a predetermined shear force.

As shown in FIGS. 2 to 4, the reverse rotation drive shaft 73 extends in the width direction of the auger housing 21, projects laterally outward from the case 63, and is connected to the left and right reverse rotation shafts 44, 44. More specifically, the reverse rotation drive shaft 73 is rotatably mounted in the left and right forward rotation drive shafts 72, 72 via left and right bearings 86, 86 (FIG. 4) and projects axially outward from left and right forward rotation drive shafts 72, 72. When the driving force is inputted to the input shaft 71, the reverse rotation drive shaft 73 is rotatable only in the reverse rotating direction Rb. The rotating direction Rb of the reverse rotation drive shaft 73 is a direction to cause the left and right reverse rotation augers 42, 42 to undergo reverse rotation.

As shown in FIG. 2, the reverse rotation drive shaft 73 has opposite longitudinal end portions, respectively, fitted in left and right reverse rotation rotating shafts 87, 87 located adjacent to the left and right forward rotation shafts 43, 43 and the left and right reverse rotation shafts 44, 44 located remotely from the left and right forward rotation shafts 43, 43. The left and right reverse rotation shafts 44, 44 are pipe-shaped shafts rotatably fitted over the reverse rotation drive shaft 73. The left and right reverse rotation rotating shafts 87, 87 are pipe-shaped shafts fitted over and connected to the reverse rotation drive shaft 73. The left and right reverse rotation rotating shafts 87, 87 are connected to the left and right reverse rotation shafts 44, 44 by means of left and right reverse rotation shear bolts 88, 88. The left and right reverse rotation shear bolts 88, 88 are fastening members which can be shorn or broken by a predetermined shear force.

As shown in FIGS. 3 and 4, the driving gear 74 is in the form of a worm or a screw gear. The driving gear 74 may be formed either as an integral part of the input shaft 71, or alternatively, as a separate member structurally independent from the input shaft.

The first driven gear 75 is disposed on the vertical plane including the center line CL (FIG. 4) in the width direction of the auger housing 21, mounted on the reverse rotation drive shaft 73, and in mesh with the driving gear 74. The first driven gear 75 is in the form of a helical gear and serration-connected to the reverse rotation drive shaft 73.

The left and right forward rotation drive shafts 72, 72 have respective inner end portions opposed to each other with the first driven gear 75 disposed therebetween. The left and right forward rotation drive shafts 72, 72 and the reverse rotation drive shaft 73 are prevented from moving in a direction along the axis Xs relative to the case 63.

The left and right second driven gears 76, 76 are provided on the left and right forward rotation drive shafts 72, 72, respectively. The left and right second driven gears 76, 76 are in the form of spur gears and serration-connected to the respective inner end portions of the left and right forward rotation drive shafts 72, 72.

More specifically, the first driven gear 75 and the left and right second driven gears 76, 76 are aligned with each other along the axis Xs with the first driven gear 75 disposed centrally between the left and right second driven gears 76, 76. The first driven gear 75 and the left and right second driven gears 76, 76 are disposed adjacent to one another. A left thrust bearing 89 is disposed between a left side surface of the first driven gear 75 and a right side surface of the left second driven gear 76, and a right thrust bearing 89 is disposed between a right side surface of the first driven gear 75 and a left side surface of the right second driven gear 76. The left and right thrust bearings 89, 89 are formed by thrust needle roller bearings, which belong to one type of needle bearings. The thrust needle roller bearings 89, 89 are small in thickness and, hence, the distance between the left and right second driven gears 76, 76 can be greatly reduced, which will lead to downsizing of the case 63. The left and right second driven gears 76, 76 are prevented from moving in a direction away from the central first driven gear 75 relative to the left and right forward rotation drive shafts 72, 72.

The counter gear 91 is provided on a counter shaft 92 extending parallel to the reverse rotation drive shaft 73 and is in mesh with the first driven gear 75. The counter gear 91 is formed by a helical gear. The first driven gear 75 formed by a helical gear is in mesh with the driving gear 74 formed by a worm or a screw gear and also in mesh with the counter gear 91 formed by a helical gear.

The counter gear 91 is serration-connected to the counter shaft 92 and hence is not rotatable relative to the counter shaft 92. The counter shaft 92 has opposite axial end portions rotatably supported by the case 63 via left and right bearings 93, 93. The counter shaft 92 is prevented from moving in an axial direction thereof.

The idle gear mechanism 94 is a mechanism which converts rotation of the counter gear 91 into rotation in a reverse direction opposite to the rotating direction of the counter gear 91 and inputs the converted rotation in the reverse direction to the left and right second driven gears 76, 76. The idle gear mechanism 94 includes left and right idle driving gears 95, 95 provided on the counter shaft 92, left and right idle driven gears 96, 96 meshing with the left and right idle driving gears 95, 95, respectively, and an idle shaft 97 on which the left and right idle driven gears 95, 95 are provided. The left and right idle driving gears 95, 95 and the left and right idle driven gears 96, 96 are spur gears.

The left and right idle driving gears 95, 95 are disposed on axial opposite sides of the counter gear 91 and serration-connected to the counter shaft 92 so that the idle driving gears 95, 95 are non-rotatable relative to the counter shaft 91. The idle shaft 97 is disposed below and in parallel relation to the counter shaft 92. The idle shaft 97 has axial opposite end portions rotatably supported by the rear case member 65 via left and right bearings 98, 98. The idle shaft 97 is prevented from moving in an axial direction thereof.

The left and right idle driven gears 96, 96 are serration-connected to the idle shaft 97 and, hence, they are non-rotatable relative to the idle shaft 97. The left and right idle driven gears 96, 96 are in mesh with the left and right second driven gears 76, 76, respectively. The left and right idle driven gears 96, 96 serve as output gears of the idle gear mechanism 94. The left and right idle driven gears 96, 96 will therefore be hereinafter referred to as "left and right output gears 96, 96". The counter gear 91, the left and right idle driving gears 95, 95, and the left and right output gears 96, 96 are all immovable in the axial direction relative to the case 63.

Operation of the transmission 35 of the forgoing construction will be described below with reference to FIG. 6. The input shaft 71 and the driving gear 74 rotate clockwise in FIG. 6 (in a direction of the arrow t1). This will cause the first driven gear 75 to rotate in a reverse rotation direction (indicated by the arrow Rb). Since the counter gear 91 is in mesh with the first driven gear 75, rotation of the first driven gear 75 causes the counter gear 91 and the left and right idle driving gears 95, 95 to rotate in an opposite direction (indicated by the arrow t2) against rotating direction of the first driven gear 75. Concurrently therewith the left and right idle driven gears 96, 96, which are in mesh with the left and right idle driving gears 95, 95, rotate in an opposite direction (indicated by the arrow t3) against the rotating direction of the left and right idle driving gears 95, 85. Similarly, the left and right second driven gears 76, 76, which are in mesh with the left and right idle driven gears 96, 96, rotate in an opposite direction (i.e., in a forward rotation direction as indicated by the arrow Ra) against the rotating direction of the left and right idle driven gears (left and right output gears) 96, 96.

Figure 6:
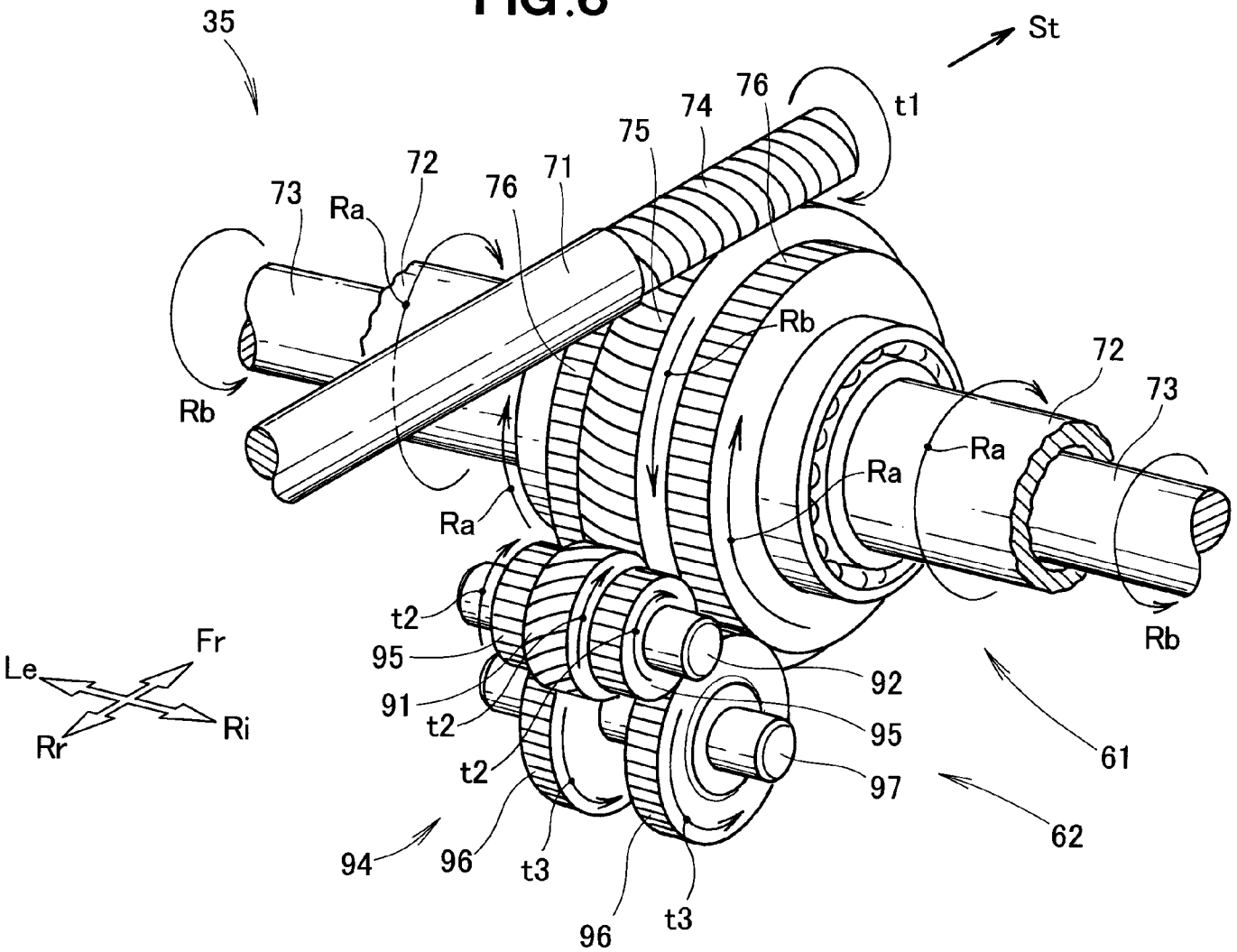
FIG. 6 is s perspective view showing a first gear unit and a second gear unit of the transmission shown in FIG. 3

As discussed above, when the input shaft 71 rotates clockwise in FIG. 6 (in the direction of arrow t1), the left and right forward rotation drive shafts 72, 72 undergo forward rotation and the left and right reverse rotation drive shafts 73, 73 undergo reverse rotation concurrently with the forward rotation of the left and right forward rotation drive shafts 72, 72.

This means that the left and right augers 41, 41 undergo forward rotation and the left and right reverse rotation augers 42, 42 undergo reverse rotation concurrently with the forward rotation of the left and right forward rotation augers 41, 41.

As previously described, the driving gear 74 is formed by a worm or a screw gear, and the first driven gear 95 and the counter gear 91 are formed by helical gears. The front case member 64 is attached to the auger housing 21. With this arrangement, when the driving gear 74 rotates in a clockwise direction (as indicated by the arrow t1) in FIG. 6, the left and right forward rotation augers 41, 41 undergo forward rotation. In this instance, the input shaft 71 is subjected to a thrust reaction force acting in a forward direction of the case 63 (as indicated by an arrow St). The thrust reaction force is borne by the front bearing 81 shown in FIG. 3.

More specifically, as shown in FIG. 3, the front end portion 71*a* of the input shaft 71 is reduced in diameter to form a stepped part, and the stepped part is in contact with a rear end face of an inner race of the front bearing 81. An outer race of the front bearing 81 has a front end face which is in contact with the front case member 64. The thus arranged front bearing 81 possesses durability which is capable of sufficiently retain or bear both a radial load and an axial load (thrust load).

Thus, the front case member 64 is provided with the front bearing 81 which is capable of retaining or bearing the thrust reaction force. More specifically, by the action of the front bearing 81, the front case member 64 is able to retain or bear a thrust reaction force occurring at the input shaft 71 during forward rotation of the left and right forward rotation augers 41, 41 and reverse rotation of the left and right reverse rotation augers 42, 42. Since the direction of acting on the case 63 by the thrust reaction force is an axial forward direction (indicated by the arrow St) of the input shaft 71, the front case member 64 can sufficiently retain the thrust reaction force as compared to an arrangement in which the rear case member is used to retain the thrust reaction force.

Furthermore, by using the driving gear 74 formed by a worm or a screw gear, the input shaft 71 is allowed to extend in the front-rear direction of the auger housing 21. Since the case 63 is split or divided into the front and rear case members 64, 65, it is possible to arrange the front bearing 81 at the front case member 64 for supporting the front part (front end portion 71*a*) of the input shaft 71 and also to arrange the rear bearing 82 at the rear case member 65 for supporting a rear part of the input shaft 71. With this arrangement, when a machining process is to be performed on the front and rear case members 64, 65 so as to produce bearing retaining portions where the front and rear bearings 81, 82 are received, the front case member 64 and the rear case member 65 can be machined separately and independently. Such separate and independent machining process insures enhanced machining accuracy. More specifically, the distance between the front bearing 81 and the rear bearing 82 can be finished with increased accuracy. Furthermore, because the front part (front end portion 71*a*) of the input shaft 71, the left and right forward rotation drive shafts 72, 72, and the reverse rotation drive shaft 73 are provided in the front case member 64, it is readily possible to maintain an excellent meshing state between the driving gear 74 and the first driven gear 75, which will lead to a reduction in the abrasion of gear teeth and an increased in the durability.

As shown in FIGS. 4 and 7 to 9, the rear case member 65 has a first through-hole 101 and a second through-hole 102 that are formed in a right sidewall 65*c* so as to allow the counter shaft 92 and the idle shaft 97 to be assembled in the case 63 from an axial direction thereof. A left sidewall 65*b* of the rear case member 65 is free of through-holes. It is possible according to the invention to provide the first and second through-holes 101, 102 in the left sidewall 65*b* of the rear case member 65 in which instance the right sidewall 65*c* remains free of through-holes. The first through-hole 101 is located above the second through-hole 102.

The first through-hole 101 is a circular hole having a size or diameter suitable for securing a proper fitting engagement with the bearing 93 used for supporting the counter shaft 92. A stop ring 103 is fitted in the first through-hole 101 for preventing the bearing 93 from coming off in the axial direction, and a bottomed annular-shaped waterproofing first cap 104 is removably press-fitted in the first through-hole 101.

The second through-hole 102 is a circular hole having a size or diameter suitable for securing a proper fitting engagement with the bearing 98 used for supporting the idle shaft 97. A stop ring 105 is fitted in the second through-hole 102 for preventing the bearing 98 from coming off in the axial direction, and a bottomed annular-shaped waterproofing second cap 106 is removably press-fitted in the second through-hole 102.

The first through-hole 101 and the second through-hole 102 are closed by a single lid 107. The lid 107 is placed over an outer surface 65*d* (hereinafter referred to as "one end face") of the right sidewall 65 in which the first and second through-holes 101, 102 are formed. The lid 107 is secured to the end face 65*d* of the right sidewall 65 by a plurality of bolts 108 (one being shown in FIGS. 4, 7 and 8.

Figure 7:
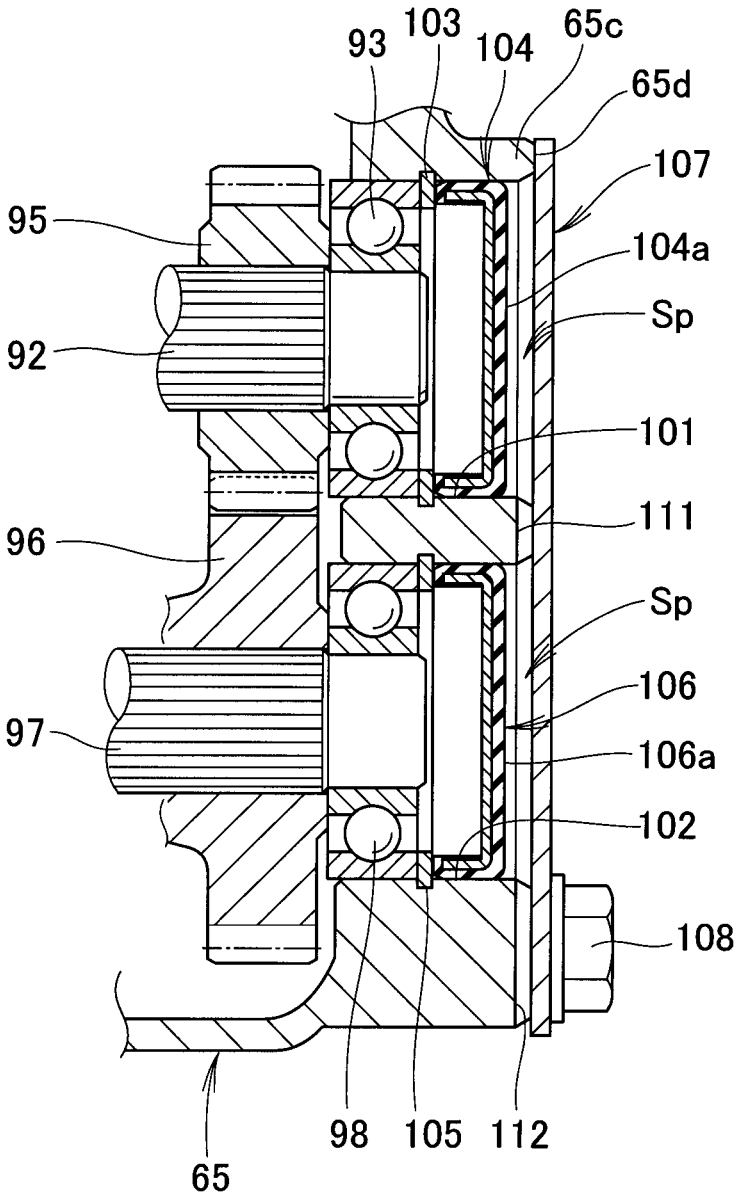
FIG. 7 is an enlarged view of bearing portions of a counter shaft and an idle shaft of the transmission shown in FIG. 4.
Figure 8:
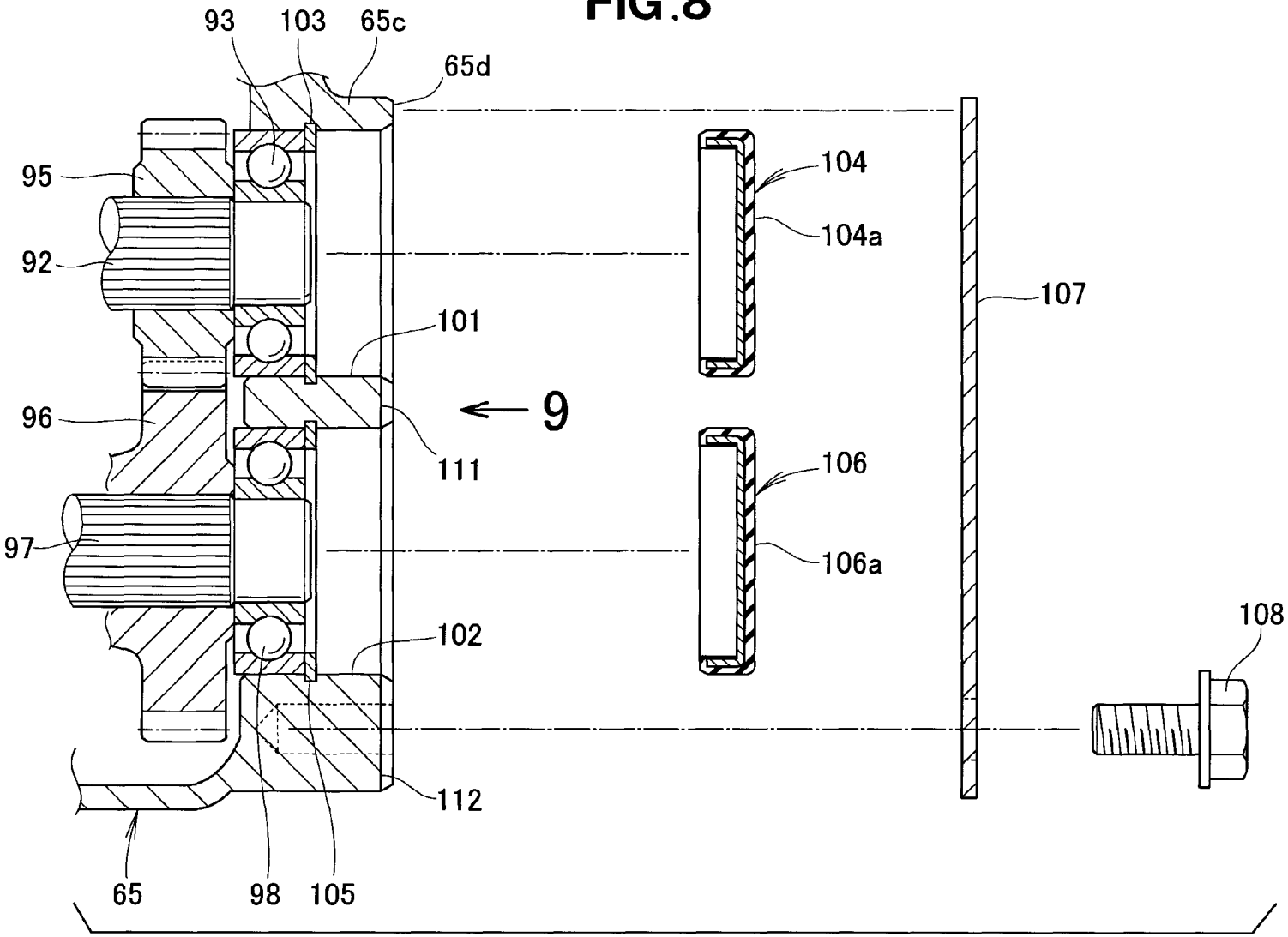
FIG. 8 is an exploded view of the bearing portions of FIG. 7 with caps and a lid removed from first and second holes.
Figure 9:
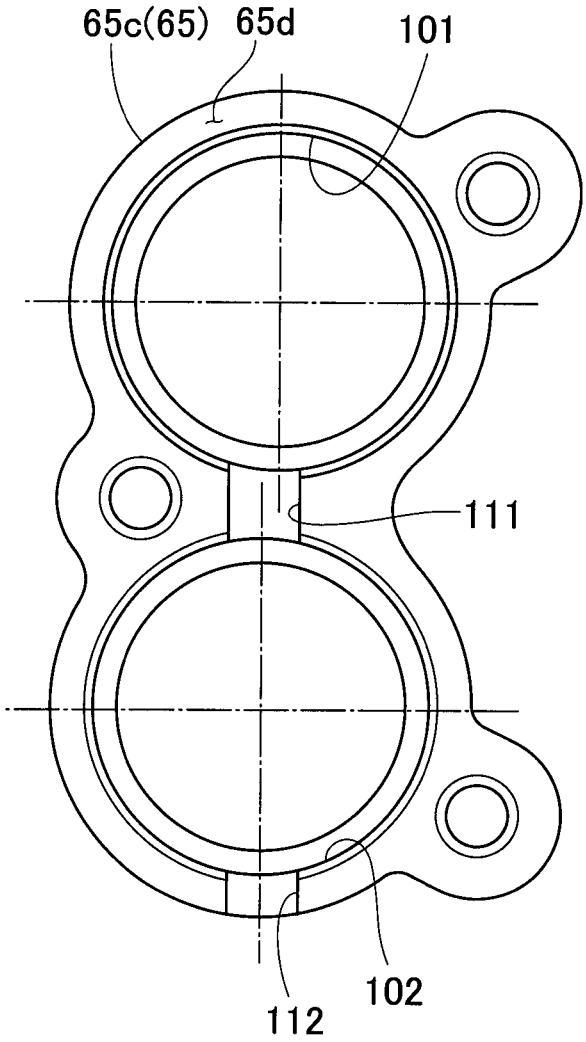
FIG. 9 is a view taken in the direction of arrow 9 in FIG. 8.

As shown in FIGS. 7-9, the end face 65*d* has upper and lower drainage grooves 111 and 112 formed therein. The upper drainage groove 111 extends in a vertical direction so as to connect a peripheral edge of the first through-hole 101 and a peripheral edge of the second through-hole 102. The lower drainage groove 112 extends in a vertical direction so as to connect the peripheral edge of the second through-hole 102 and a lower end of the end face 65*d* of the right sidewall 65. The upper drainage groove 111 and the lower drainage groove 112 are vertically aligned with each other, as shown in FIG. 9. End faces 104*a*, 106*a* of the first and second caps 104, 106 and the lid 107 define therebetween small spaces or gaps Sp, Sp. The upper and lower spaces Sp, Sp communicate through the upper and lower drainage grooves 111, 112 with the outside of the case 63 at the lower end of the end face 65*d* of the right sidewall 65.

The snow-removing machine 10 (FIG. 1) is usually used during snowfall and it is likely to occur that snow is deposited on the rear case member 65 and, thereafter, the deposited snow melts and enters the upper and lower spaces Sp, Sp in the case 63. In this instance, however, by virtue of the upper and lower drainage grooves 111, 112, water of melted snow infiltrated in the spaces Sp, Sp inside the case 63 can smoothly be discharged to the outside of the case 63.

As described thus far, the case 63 of the transmission 35 disposed inside the auger housing 21 is a split case divided into the front case member 64 and the rear case member 65 at a position behind the reverse rotation drive shaft 73, as shown in FIG. 1.

As shown in FIGS. 3 and 4, the front case member 64 has the first gear unit (front gear unit) 61 assembled therein, and the first gear unit 61 includes the input shaft 71, the left and right forward rotation drive shafts 72, 72, the reverse rotation drive shaft 73, the driving gear 74, the first driven gear 75, and the left and right second driven gear 76. The rear case member 65 has the second gear unit (rear gear unit) 62 assembled therein, and the second gear unit 62 includes the counter gear 91, and the idle gear mechanism 94.

With this arrangement, as shown in FIG. 1, the case 63 disposed inside the auger housing 21 is allowed to have a reduce forward protrusion length, which is an amount of protrusion of a front end of the case 63 in a forward direction from the reverse rotation drive shaft 73. By thus reducing the forward protrusion length of the case 63, snow collected by auger 23 within the auger housing 21 is hard to adhere to and stay on the front part of the case 63. As a consequence, a highly efficient snow removing operation can be achieved.

As shown in FIGS. 3 and 4, the first gear unit 61 and the second gear unit 62 are assembled in the front case member 64 and the rear case member 65, respectively, before the front and rear case members 64, 65 are assembled together. With this arrangement, the first and second gear units 61, 62 can be readily brought into an assembled state when the front and rear case members 64, 65 are assembled together.

Furthermore, when the first gear unit 61 is assembled in the front case member 64, phases of the first driven gear 75 and the left and right second driven gears 76, 76 can be easily aligned.

Similarly, when the second gear unit 62 is assembled in the rear case member 65, phases of the counter gear 91 and the left and right idle driving gears 95, 95 can be easily aligned.

For example, when the counter gear 91 formed by a helical gear the left and right idle driving gears 95, 95 formed by spur gears are to be assembled on the counter shaft 92 within the rear case member 65, it is not easy to bring teeth of the gears 91, 95, 95 into exact alignment with one another. According to the embodiment of the invention, each of the gears 91, 95, 95 has a matching mark (not shown) formed on one tooth thereof for alignment with another gear. With the matching marks thus provided, the gears 91, 95, 95 can readily be aligned in phase with one another merely by bringing each matching mark into alignment with another matching mark by sight. The phase-aligned gears 91, 95, 95 are then assembled on the counter shaft 92 within the rear case member 65. By virtue of the matching marks, assembly workability of the gears 61, 95, 95 are greatly increased.

Furthermore, unlike an arrangement in which the case 63 is divided into two case members in an axial direction of the reverse rotation drive shaft 73, the case 63 in the illustrated embodiment is divided in two case members in a direction perpendicular to an axis of the reverse rotation drive shaft 73, as shown in FIGS. 3 and 3. This arrangement allows the front and rear case members 64, 65 to be machined separately and independently when bearing/seal retaining portions for receiving respectively therein the bearings 81-83, 86, 93, 98 and seals 121, 122, 122 are to be formed in the front and rear case members 64, 65. Such separate and independent machining process insures enhanced workability and machining accuracy of the case 62. Furthermore, the seal 121 (FIG. 3) for sealing the input shaft 71 and the seals 122, 122 (FIG. 4) for sealing the left and right forward rotation drive shafts 72, 72 can possess high sealing properties.

Furthermore, the overall size of the case 63 is not greater than, but substantially the same as, that of the case shown in JP 2004-360369 A. It will be appreciated that the case 63 excels in sealing property, workability and machining accuracy, and the transmission 35 possesses high assembly workability while maintaining compactness thereof.

The present invention is particularly suitable for application in an auger snow-removing machine having an auger driven by an engine.

Obviously, various minor changes and modifications of the present invention are possible in the light of the above teaching. It is therefore to be understood that within the scope of the appended claims the invention may be practiced otherwise than as specifically described.

What is claimed is:

1. An auger snow-removing machine comprising:

an auger housing arranged at a front end of the snow-removing machine when seen in its forward advancing direction, the auger housing having a width direction extending from a left side to a right side of the snow-removing machine;

a forward rotation shaft provided with a forward rotation auger and a reverse rotation shaft provided with a reverse rotation auger, the forward rotation shaft and the reverse rotation shaft being disposed on the same axis and aligned in the width direction of the auger housing within the auger housing; and a transmission disposed inside the auger housing such that the forward rotation shaft and the reverse rotation shaft are rotated concurrently in opposite directions by a driving force transmitted from the transmission, wherein the transmission includes:

an input shaft to which the driving force is inputted;

a reverse rotation drive shaft connected to the reverse rotation shaft and extending in the width direction of the auger housing;

a forward rotation drive shaft connected to the forward rotation shaft and extending in the width direction of the auger housing;

a driving gear provided on the input shaft;

a first driven gear provided on the reverse rotation drive shaft and meshing with the driving gear;

a counter gear meshing with the first driven gear;

an idle gear mechanism for converting rotation of the counter gear to rotation in a reverse direction, the idle gear mechanism having an output gear;

a second driven gear provided on the forward rotation drive shaft and meshing with the output shaft of the idle gear mechanism; and a case, wherein the case is a split case divided into a front case member and a rear case member at a position behind the reverse rotation drive shaft when seen in the forward advancing direction of the snow removing machine, the rear case member being disposed rearward of the front case member, wherein the front case member has a first gear unit pre-assembled therein, the first gear unit including the input shaft, the reverse rotation drive shaft, the forward rotation drive shaft, the driving gear, the first driven gear, and the second driven gear, and wherein the rear case member has a second gear unit pre-assembled therein, the second gear unit including the counter gear, and the idle gear mechanism, such that the first and second gear units can readily be brought into an assembled state when the front and rear case members are assembled together.

2. The auger snow-removing machine according to claim 1, wherein the driving gear is a worm or a screw gear, the first driven gear and the counter gear are helical gears, and the front case member is mounted to the auger housing and provided with a bearing capable of retaining a thrust reaction force occurring at the input shaft when the forward rotation auger is undergoing forward rotation and the reverse rotation auger is undergoing reverse rotation concurrently with forward rotation of the forward rotation auger.

* * * * *